US008978950B2

(12) United States Patent
Yamamoto et al.

(10) Patent No.: US 8,978,950 B2
(45) Date of Patent: Mar. 17, 2015

(54) FUEL CONTAINER HOLDING STRUCTURE

(75) Inventors: Hiroki Yamamoto, Tokyo (JP); Yasushi Yokochi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 314 days.

(21) Appl. No.: 13/486,353

(22) Filed: Jun. 1, 2012

(65) Prior Publication Data

US 2012/0312829 A1 Dec. 13, 2012

(30) Foreign Application Priority Data

Jun. 10, 2011 (JP) ..... 2011-129817

(51) Int. Cl.
*B25C 1/08* (2006.01)

(52) U.S. Cl.
CPC ..... *B25C 1/08* (2013.01)
USPC ..... 227/10; 227/130; 123/46 SC

(58) Field of Classification Search
USPC ..... 227/8, 9, 10, 130; 123/46 SC, 46 R, 495; 285/3, 148.23
See application file for complete search history.

(56) References Cited

U.S. PATENT DOCUMENTS 4,483,474 A * 11/1984 Nikolich ..... 227/8
4,522,162 A * 6/1985 Nikolich ..... 123/46 SC
4,739,915 A * 4/1988 Cotta ..... 227/10
5,263,439 A * 11/1993 Doherty et al. ..... 123/46 SC
5,971,245 A 10/1999 Robinson
6,523,860 B1 * 2/2003 Shkolnikov et al. ..... 285/3
6,629,650 B2 * 10/2003 Curran et al. ..... 239/585.1
6,786,378 B2 * 9/2004 Wagdy et al. ..... 227/9
7,591,249 B2 * 9/2009 Wagdy et al. ..... 123/495
8,413,864 B2 * 4/2013 Wolf ..... 227/10
8,544,710 B2 * 10/2013 Tanaka ..... 227/10
2008/0245837 A1 * 10/2008 Wolf ..... 227/9
2010/0096426 A1 4/2010 Tarnawiecki

FOREIGN PATENT DOCUMENTS

DE 10 2006 000 233 11/2007
EP 1 977 864 A1 10/2008
JP A-2005-342823 12/2005
JP A-2009-078340 4/2009
JP A-2009-275874 11/2009

* cited by examiner

*Primary Examiner* — Scott A. Smith
(74) *Attorney, Agent, or Firm* — Drinker Biddle & Reath LLP

(57) ABSTRACT

A fuel container holding structure for detachably holding a fuel container 40 including a nozzle 44 in its front end portion is provided with a front end holding portion 22 for holding the front end portion of the fuel container 40 and a rear end holding portion 28 for holding a rear end portion of the fuel container 40. The front end holding portion 22 includes a connecting portion 23 to which the nozzle 44 is connected and a buffer mechanism 25, 42 disposed between the connecting portion 23 and fuel container 40. The fuel container 40 is supported by the buffer mechanism 25, 42.

7 Claims, 6 Drawing Sheets

FUEL CONTAINER HOLDING STRUCTURE

BACKGROUND OF THE INVENTION

1. Field of the Invention

The present invention relates to a fuel container holding structure which can protect a fuel container against impacts.

2. Related Art

Generally, in a gas combustion type driving tool, a fuel container with liquefied fuel gas filled therein is mounted into a tool, the fuel gas supplied from the fuel container is charged into a sealed combustion chamber, the fuel gas and air are mixed within the combustion chamber to produce a mixture gas, and a fastening member is driven by a combustion pressure produced by a combustion of the mixture gas.

The fuel container is detachably stored in a fuel container storing portion in a housing of a main body of the tool. When the fuel in the fuel container runs out, the fuel container is replaced.

A conventional gas combustion type driving tool has a problem that impacts produced in its driving time are transmitted to the fuel container and the fuel container may be broken. For example, in the case that the fuel container is a gas can including an aluminum-made inner bag filled with fuel gas, there is a problem that the inner bag can be creased by the impacts occurring in the tool driving time, thereby producing cracks and holes in the inner bag of the gas can (a pinhole phenomenon). When such holes are formed in the inner bag of the gas can, the fuel gas within the inner bag and compressed gas (nitrogen or the like) outside the inner bag are mixed together, thereby causing a poor injection of the fuel gas. In the case that the fuel gas cannot be ignited due the poor injection thereof, even when the fuel remains in the fuel container, the fuel container is unusable.

To avoid such problem, a structure to buffer the impacts transmitted to the fuel container is considered. For example, DE102006000233A1 discloses a structure in which an elastic force is applied through a spring to a connecting element for connecting the fuel container. In this structure, the impacts to be transmitted to the fuel container can be absorbed by the spring.

However, in the structure of the DE102006000233A1, there is a problem that, since the connecting element is held by the spring, a space for disposing the spring is necessary.

SUMMARY OF THE INVENTION

Embodiments of the invention relate to a fuel container holding structure which can buffer impacts to be transmitted to the fuel container, and can eliminate a space for disposing a spring for holding a connecting element, thereby being able to realize a spacing saving thereof.

DETAILED DESCRIPTION OF THE EMBODIMENTS

Description will be given below of an exemplary embodiment of a fuel container holding structure with reference to the accompanying drawings, while taking a gas combustion type driving tool 10 as an example.

Figure 1:
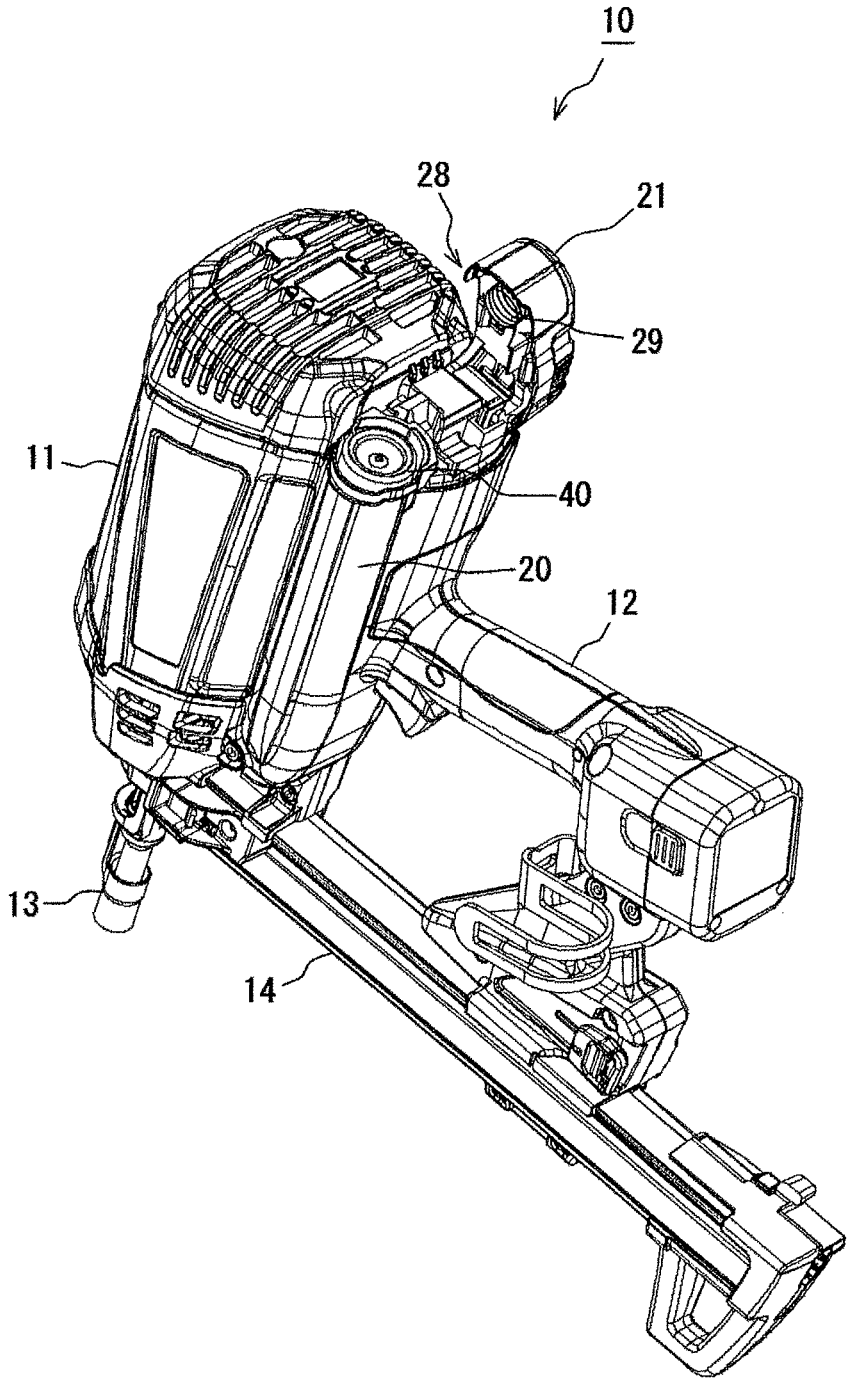
FIG. 1 is an external view of a gas combustion type driving tool.

In the gas combustion type driving tool 10 of the exemplary embodiment, as shown in FIG. 1, a grip housing 12 is provided backwardly of a body housing 11 continuously therewith. On a lower portion of the body housing 11, there is mounted a nose portion 13 for driving and guiding a nail into a driven work-piece. A magazine 14 with a large number of nails accommodated therein is provided laterally of the nose portion 13 continuously therewith. The nails within the magazine 14 are supplied sequentially to the nose portion 13, and the nails supplied to the nose portion 13 are struck by a striking mechanism (not shown) within the body housing 11 and are driven out from the injection port of a leading end of the nose portion 13 into the driven work-piece.

In the striking mechanism, fuel gas and air are mixed together in a combustion chamber formed within the body housing 11 to generate a mixture gas, the pressure of a combustion gas produced by a combustion of the mixture gas is applied to a striking piston, and the nails are struck by the striking piston.

The supply of the fuel gas into the combustion chamber is carried out through a supply port facing an inside of the combustion chamber. A gas supply pipe is connected to the supply port, whereby the fuel gas injected from an electromagnetic valve device is guided to the combustion chamber. The electromagnetic valve device is connected to a fuel container 40 with liquefied fuel gas filled therein. The electromagnetic valve device measures the fuel to be supplied from the fuel container 40 and injects a given amount of fuel gas into the combustion chamber.

Figure 3:
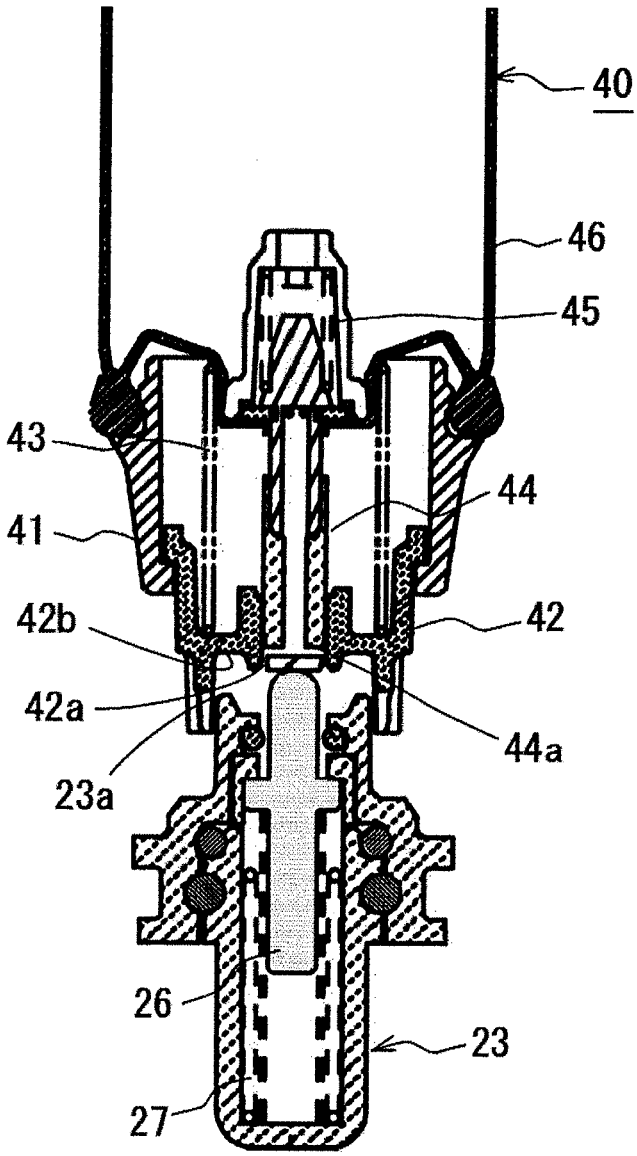
FIG. 3 is a partially enlarged section view of the fuel container storing portion, showing a state where a fuel container is being mounted therein.
Figure 4:
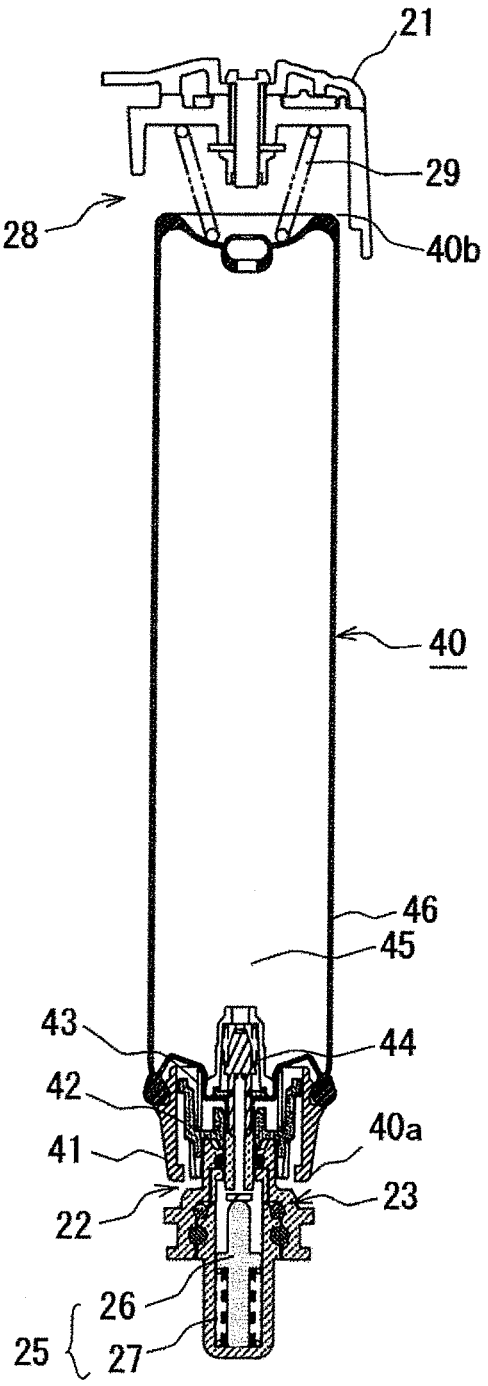
FIG. 4 is a section view of the fuel container storing portion, showing a state after the fuel container is mounted.

The fuel container 40 of the exemplary embodiment is a tubular (cylindrical) gas can. As shown in FIGS. 3 and 4, the fuel container 40 includes a fuel filling portion 46 for filling the fuel gas therein, a cap member 41 fitted and fixed to the front end of the fuel filling portion 46, a slide member 42 slidable out of and into the cap member 41 along its inside, and a nozzle 44 movable out of and into a nozzle hole 42 formed in the center of the slide member 42. The slide member 42 is energized in its projecting direction by a coil spring 43.

The fuel filling portion 46 has a dual structure constituted of an outer can and an inner bag disposed within the outer can. Liquefied fuel gas is filled within the inner bag. In a space between the outer can and inner bag, there is filled compressed gas having a higher pressure than a pressure of the fuel gas. The compressed gas presses a surface of the inner bag to compress it, whereby the fuel gas is injected from the nozzle 44.

A role of a valve for adjusting the injection of the fuel gas is played by the slide member 42. The nozzle 44 is used to inject the fuel gas and is energized in the projecting direction by a nozzle energizing member 45.

According to the exemplary embodiment, the fuel container 40, as shown in FIG. 1, is stored in a fuel container storing portion 20 formed substantially parallel to a nail drive-out direction. The fuel container storing portion 20 includes a lid 21 mounted such that it can be opened and closed through a hinge. By rotating the lid 21, the fuel container storing portion 20 can be opened and closed. When the lid 21 is opened, as shown in FIG. 1, an upper surface of the fuel container storing portion 20 is opened, whereby the fuel container 40 stored in the fuel container storing portion 20 can be taken out or the fuel container 40 can be inserted into the fuel container storing portion 20.

Figure 2:
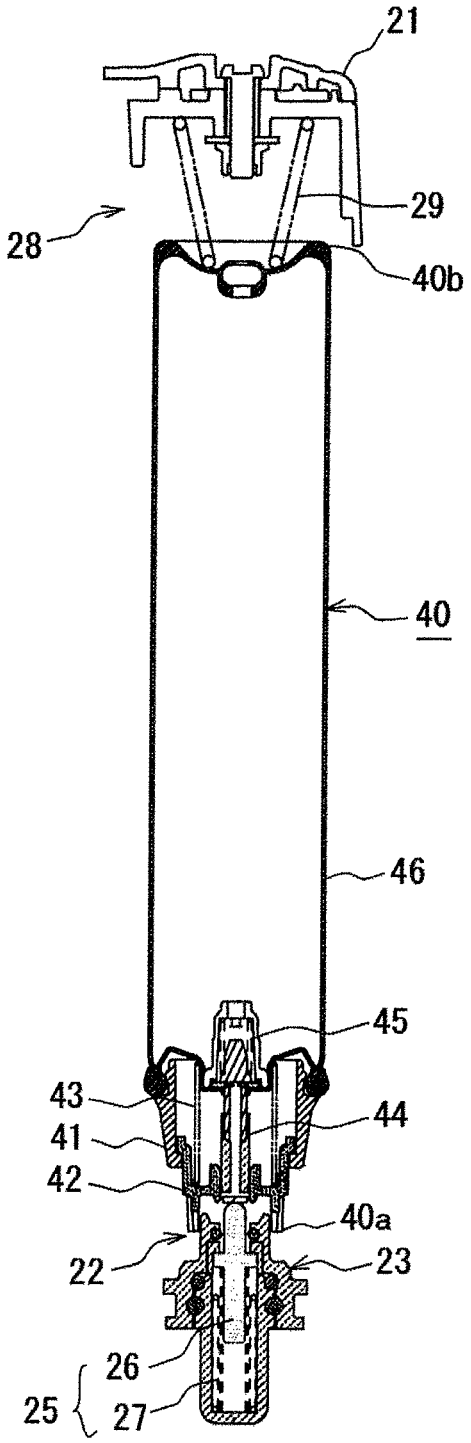
FIG. 2 is a section view of a fuel container storing portion, showing a state where a fuel container is being mounted therein.

The fuel container 40 is inserted and stored into the fuel container storing portion 20 from a front end portion 40*a* with the nozzle 44 formed therein. The fuel container storing portion 20, as shown in FIG. 2, includes a front end holding portion 22 for holding the front end portion 40*a* of the fuel container 40 and a rear end holding portion 28 for holding the rear end portion 40*b* of the fuel container 40. The hold portions 22 and 28 hold therebetween the fuel container 40 from both sides.

The front end holding portion 22, as shown in FIG. 2, includes a connecting unit 23. The connecting unit 23 is used to connect the nozzle 44 of the fuel container 40 and is removably fixed to the grip housing 12.

Specifically, the connecting unit 23 includes a connecting unit main body 23A which is immovable relative to the main body of the driving tool 10. The connecting unit main body 23A includes an internal space 23B (see FIG. 5). The connecting unit 23 includes a valve 25 for opening and closing a fuel supply passage extending from the fuel container 40 to the electromagnetic valve device. The valve 25 includes a valve body 26 to be pressed in the opening direction when the nozzle 44 of the fuel container 40 is connected, and a valve body energizing member 27 made of a compression spring for energizing the valve body 26 in the closing direction. The valve body 26 and valve body energizing member 27 are stored within the internal space 23B.

Figure 5:
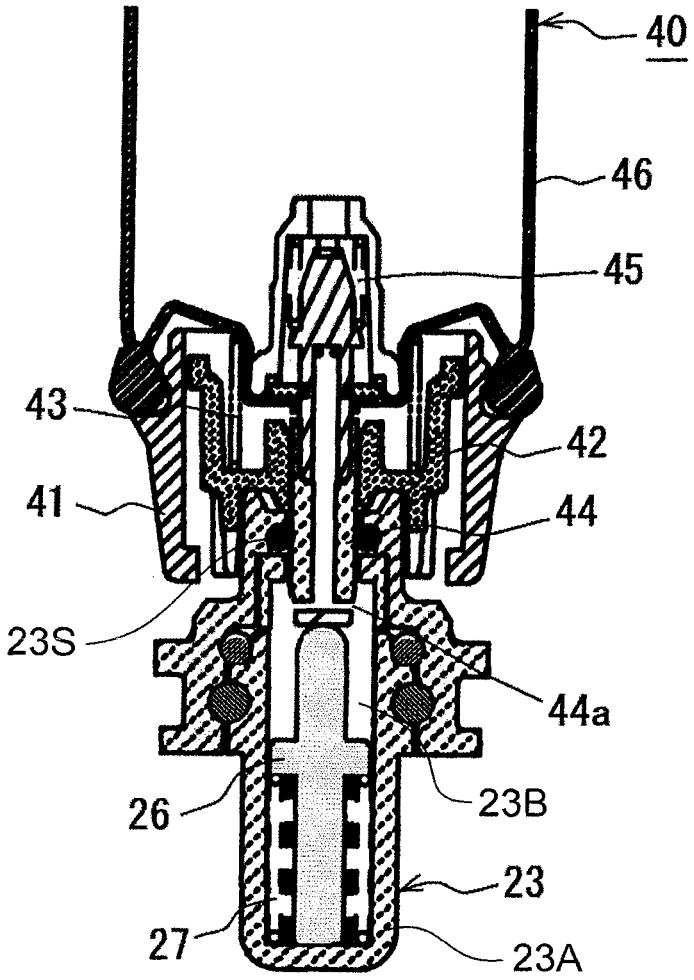
FIG. 5 is a partially enlarged section view of the fuel container storing portion, showing a state after the fuel container is mounted.

As shown in FIG. 5, when the fuel container 40 is mounted in the fuel container storing portion 20, the nozzle 44 of the fuel container 40 is inserted from the upper opening of the internal space 23B of the connecting unit 23 into the internal space 23B. Also, a seal 23B made of an O ring is provided on the inner periphery of the upper opening of the internal space 23B of the connecting unit 23. When the fuel container 40 is mounted in the fuel container storing portion 20 and the nozzle 44 of the fuel container 40 is inserted in the internal space 23B, this seal is contacted with the outer periphery of the nozzle 44 to seal between the inside and outside of the internal space 23B. The internal space 23B is connected to the electromagnetic valve device. When the fuel container 40 is connected to the connecting unit 23, the fuel within the fuel container 40 is supplied to the electromagnetic valve device through the internal space 23B.

As shown in FIG. 3, before the fuel container 40 is mounted, the valve body 26 is energized by the valve body energizing member 27 in the closing direction (a direction where the nozzle 44 is connected; namely, in the upper direction in FIG. 3) and thus the valve 25 closes the fuel supply passage, thereby preventing the fuel from being supplied from the fuel container 40 to the electromagnetic valve device. After the fuel container 40 is mounted, as shown in FIG. 5, the nozzle 44 pushes the valve body 26 inwardly against the energizing force of the valve body energizing member 27 to open the valve 25, whereby the fuel is supplied from the fuel container 40 to the electromagnetic valve device.

Here, to supply the fuel from the fuel container 40 to the electromagnetic valve device, in addition to the opening of the valve 25 of the connecting unit, it is necessary to inject the fuel from the nozzle 44 of the fuel container 40. Before the fuel container 40 is connected to the connecting unit 23, as shown in FIG. 3, an injection port 44*a* formed in the leading end of the nozzle 44 is buried in the slide member 42 and is thereby closed to prevent the gas from leaking to the outside. Therefore, to supply the fuel from the fuel container 40 to the electromagnetic valve device, it is necessary to expose the injection port 44*a* and inject the fuel from the nozzle 44.

According to the exemplary embodiment, by connecting the fuel container 40 to the connecting unit 23, the fuel is injected from the nozzle 44 of the fuel container 40. That is, when the fuel container 40 is connected to the connecting unit 23, the projecting end portion 23*a* of the connecting unit 23 is fitted into a peripheral groove portion 42*b* formed in the periphery of the nozzle hole 42*a* of the slide member 42, thereby pressing the slide member 42 inwardly. Accordingly, the slide member 42 is moved inwardly against the energizing force of a coil spring 43 and, as shown in FIG. 5, the leading end of the nozzle 44 is projected to the outside of the slide member 42 to expose the injection port 44*a*. This enables the fuel to be injected from the fuel container 40. Thus, by applying a load to the front end portion 40*a* (slide member 42) of the fuel container 40, the fuel can be injected from the nozzle 44 of the fuel container 40.

According to the exemplary embodiment, the valve body 26 for elastically receiving the nozzle 44 of the fuel container 40 serves as a buffer member and supports the front end portion 40*a* of the fuel container 40. The valve 25 including the valve body 26 and valve body energizing member 27 functions as a buffer mechanism interposed between the connecting unit 23 and fuel container 40. In other words, the bottom dead center of the fuel container 40 is determined by the nozzle 44 elastically supported by the buffer mechanism.

Also, the slide member 42 for elastically receiving the projecting end portion 23*a* of the connecting unit 23 also functions as a buffer mechanism interposed between the connecting unit 23 and fuel container 40.

Therefore, as shown in FIG. 5, any buffer mechanism always intervenes between the fuel filling portion 46 of the fuel container 40 and connecting unit 23, while other portion than the buffer mechanism is prevented from touching the front end portion 40*a* of the fuel container 40. Accordingly, even when impacts are applied to the front end holding portion 22 of the fuel container storing portion 20, such impacts are not applied directly to the fuel filling portion 46. This can prevent the fuel filling portion 46 against damage (a pinhole phenomenon in which the inner bag is creased to cause cracks or holes therein).

The rear end holding portion 28, as shown in FIG. 2, includes a rear end buffer member 29 made of a compression spring for buffering impacts applied to the rear end portion 40*b* of the fuel container 40. The rear end buffer member 29 is provided on the back surface of the lid 21. When the lid 21 with the fuel container 40 stored is closed, the rear end buffer member 29 presses the fuel container 40 in the direction of the connecting unit 23, whereby the fuel container 40 is fixed within the fuel container storing portion 20; and, when the impacts are applied, the rear end buffer member 29 is elastically deformed to buffer impacts applied to the fuel container 40.

Figure 6A:
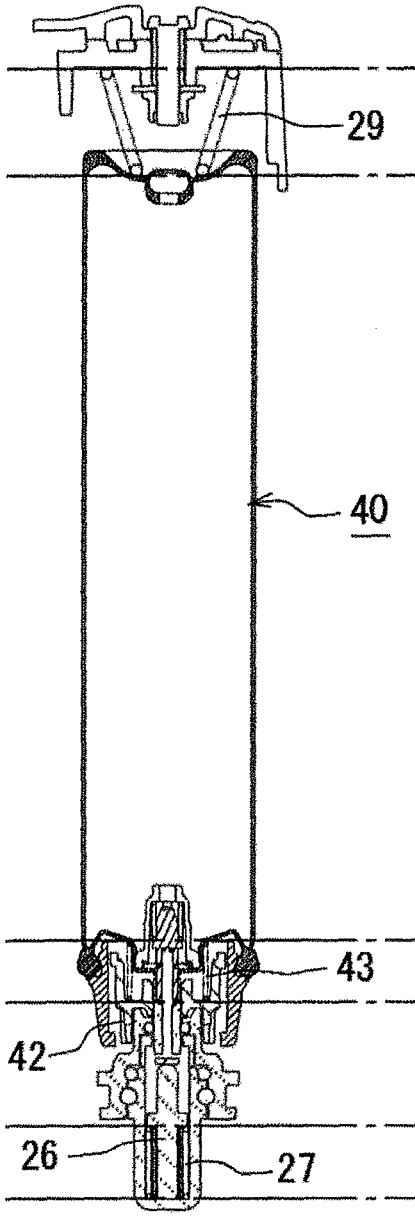
FIGS. 6A and 6B are explanatory views to show how the fuel container moves within the fuel container storing portion.
Figure 6B:
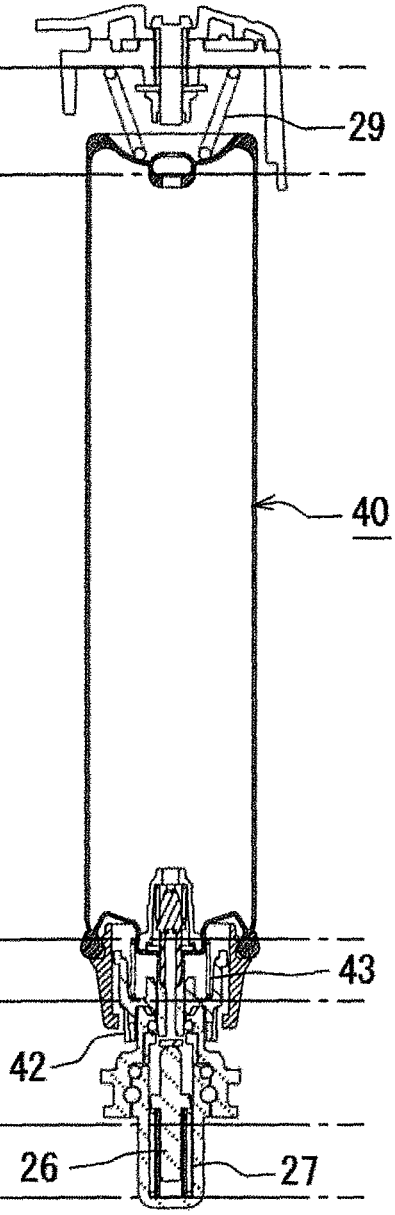

FIGS. 6A and 6B are explanatory views to show how the fuel container 40 moves within the fuel container storing portion 20. As shown in FIGS. 6A and 6B, in the case that impacts are applied to the fuel container 40 when nails are driven by the gas combustion type driving tool 10, the valve body energizing member 27, rear end buffer member 29 and coil spring 43 are respectively expanded and contracted to move the fuel container 40 in the longitudinal direction, thereby buffering the impacts to be applied to the fuel container 40.

The energizing load of the rear end buffer member 29 is set larger than that of the valve body energizing member 27. This aims to avoid a problem that the rear end buffer member 29 absorbs the energizing load of the valve body energizing member 27 to thereby prevent the valve body 26 from opening.

A load obtained by subtracting the energizing load of the valve body energizing member 27 from that of the rear end buffer member 29 is larger than the energizing load of the coil spring 43. This aims to avoid a problem that the load obtained by subtracting the energizing load of the valve body energizing member 27 from that of the rear end buffer member 29 is too small to push the slide member 42 inwardly against the energizing force of the coil spring 43, is thereby failing to inject the fuel from the fuel container 40.

Here, the buffer mechanism is not limited to the above structure. For example, such a clearance may be formed as to prevent direct contact between the connecting unit 23 and fuel container 40, and a buffer member such as a spring or rubber may be disposed in this clearance. In this case, the buffer member may be provided in the connecting unit 23, or may be provided inside the grip housing 12 (inside the fuel container storing portion 20).

In the above embodiment, the fuel container 40 is stored in the fuel container storing portion 20 substantially parallel to the nail drive-out direction. However, this is not limitative. For example, a fuel container storing portion for containing a fuel container may be formed substantially perpendicularly to the drive-out direction of the grip or magazine, and a buffer mechanism may be provided in this fuel container storing portion.

In the above embodiment, a compression spring is used as the rear end buffer member 29. However, this is not limitative. For example, the rear end buffer member 29 may also be made of high polymer material such as soft plastic. When the rear end buffer member 29 is made of high polymer material, when compared with a spring, the impact can be absorbed quickly without damaging the fuel container 40.

As described above, in accordance with the exemplary embodiment and its modification, the fuel container holding structure for detachably holding the fuel container 40 including the nozzle 44 in its front end portion may include a front end holding portion 22 for holding the front end portion of the fuel container 40 and a rear end holding portion 28 for holding the rear end portion thereof. The front end holding portion 22 may include a connecting portion 23 with the nozzle 44 connectable thereto, and buffer mechanism 25, 42 to be disposed between the connecting portion 23 and fuel container 40. The fuel container 40 may be supported by the butter mechanism 25, 42.

According to this structure, the buffer mechanism is interposed between the connecting unit 23 and fuel container 40 and the fuel container 40 itself is received by the buffer mechanism, thereby being able to realize space saving.

The buffer mechanism 25 may include a buffer member 26 for receiving the nozzle 44 elastically.

According to this structure, since the buffer mechanism can be provided within the connecting unit 23, space saving can be realized and standardized design or model development can be facilitated. Also, since the connecting unit 23 is removable, maintenance such as cleaning can also be facilitated.

Within the connecting portion 23, there may be provided a valve 25 for opening and closing the fuel supply passage. The valve 25 may include a valve body 26 to be pressed in the opening direction when the nozzle 44 is connected, and a valve body energizing member 27 for energizing the valve body 26 in the closing direction. The buffer mechanism may receive the nozzle 44 elastically due to the energizing force of the valve body energizing member 27.

According to this structure, since the buffer mechanism can be provided within the connecting unit 23, space saving can be realized and standardized design or model development can be facilitated. Also, when the connecting unit 23 is removable, maintenance such as cleaning can also be facilitated. And, since the valve 25 functions also as the buffer mechanism, this structure can be manufactured without increasing the number of conventional parts.

The connecting portion 23 may include a connecting unit main body 23A immovable relative to the main body of the driving tool 10, while an internal space 23B may also be formed within the connecting unit main body 23A. The valve body 26 and valve body energizing member 27 may be stored in the internal space 23B. This space 23B may be structured such that, while the fuel container 40 is mounted in the fuel container storing portion 20 of the driving tool 10, the nozzle 44 of the fuel container 40 is moved into this space 23B. This space 23B may be connected to the combustion chamber side of the driving tool 10.

The rear end holding portion 28 may include a rear end buffer member 29 for buffering impacts applied to the rear end portion of the fuel container 40.

According to this structure, the front end portion 40*a* of the fuel container 40 is held by the buffer mechanism and the rear end portion 40*b* thereof is held by the rear end buffer member 29. Thus, impacts can be absorbed the moment they are applied to the tool and also when the fuel container 40 is moved due to its reaction, thereby being able to further buffer impacts applied to the fuel container 40.

The energizing load of the rear end buffer member 28 may be larger than that of the valve body energizing member 27. This structure can avoid the problem that the rear end buffer member absorbs the load to prevent the valve body from opening.

A load obtained by subtracting the energizing load of the valve body energizing member 27 from that of the rear end buffer member 28 may be larger than a load which must be applied to the front end portion of the fuel container 40 in order to inject the fuel from the nozzle 40.

This structure can avoid the problem that the load obtained by subtracting the energizing load of the valve body energizing member from that of the rear end buffer member is too small to open the valve of the fuel container, thereby failing to inject fuel gas.

The buffer mechanism may include a slide member 42 which is connected to the fuel container 40, is energized toward the connecting portion 23 by the spring 43, and, while the fuel container 40 is mounted in the fuel container storing portion 20 of the driving tool 10, can be elastically contacted with the projecting end portion 23*a* of the connecting portion 23.

The rear end holding portion 28 may include a rear end buffer member 29 made of high polymer material for buffering impacts applied to the rear end portion of the fuel container 40.

According to this structure, the front end portion of the fuel container is held by the buffer mechanism and the rear end portion thereof is held by the rear end buffer member. Thus, impacts can be absorbed the moment they are applied to the tool and also when the fuel container is moved due to its reaction. This can further buffer impacts applied to the fuel container. Also, since the is rear end buffer member made of high polymer material, when compared with a spring, the impacts can be absorbed quickly without damaging the fuel container.

DESCRIPTION OF REFERENCE NUMERALS AND SIGNS

10: Gas combustion type driving tool
11: Body housing
12: Grip housing
13: Nose portion
14: Magazine
20: Fuel container storing portion
21: Lid
22: Front end holding portion
23: Connecting unit (connecting portion)
23*a*: Projecting end portion
25: Valve
26: Valve body (buffer member)
27: Valve body energizing member
28: Rear end holding portion
29: Rear end buffer member
40: Fuel container
40*a*: Front end portion
40*b*: Rear end portion
41: Cap member 42: Slide member
42*a*: Nozzle hole
42*b*: Peripheral groove portion
43: Coil spring
44: Nozzle
44*a*: Injection port
45: Nozzle energizing member
46: Fuel filling portion

What is claimed is:

1. A fuel container holding structure in which a fuel container including a nozzle in its front end portion is detachably held, the fuel container holding structure comprising:

a front end holding portion adapted to hold the front end portion of the fuel container; and a rear end holding portion adapted to hold a rear end portion of the fuel container, wherein the front end holding portion includes:

a connecting portion to which the nozzle is connectable; and a buffer mechanism disposed between the connecting portion and the fuel container, wherein the fuel container is supported by the buffer mechanism, wherein a valve adapted to open and close a fuel supply passage is disposed within the connecting portion, wherein the valve includes a valve body to be pressed in its opening direction when the nozzle is connected to the connecting portion, and a valve body energizing member adapted to energize the valve body in its closing direction, and wherein the buffer mechanism is adapted to elastically receive the nozzle by an energizing force of the valve body energizing member.

2. The fuel container holding structure according to claim 1, wherein the buffer mechanism includes a buffer member adapted to elastically receive the nozzle.

3. The fuel container holding structure according to claim 1, wherein the rear end holding portion includes a rear end buffer member adapted to buffer an impact applied to the rear end portion of the fuel container, and wherein an energizing load of the rear end holding portion is larger than an energizing load of the valve body energizing member.

4. The fuel container holding structure according to claim 3, wherein a load obtained by subtracting the energizing load of the valve body energizing member from that of the rear end holding portion is larger than a load which must be applied to a front end portion of the fuel container in order to inject fuel from the nozzle.

5. The fuel container holding structure according to claim 1, wherein the buffer mechanism includes a slide member connected to the fuel container, wherein the slide member is energized toward the connecting portion by a spring, and wherein the slide member is configured to be elastically contacted with a projecting end portion of the connecting portion in a condition that the fuel container is mounted in the fuel container storing portion of the driving tool.

6. The fuel container holding structure according to claim 1, wherein the rear end holding portion includes a rear end buffer member made of a high polymer material that buffers an impact applied to the rear end portion of the fuel container.

7. A fuel container holding structure in which a fuel container including a nozzle in its front end portion is detachably held, the fuel container holding structure comprising:

a front end holding portion adapted to hold the front end portion of the fuel container; and a rear end holding portion adapted to hold a rear end portion of the fuel container, wherein the front end holding portion includes:

a connecting portion to which the nozzle is connectable; and a buffer mechanism disposed between the connecting portion and the fuel container, wherein the fuel container is supported by the buffer mechanism, wherein a valve adapted to open and close a fuel supply passage is disposed within the connecting portion, wherein the valve includes a valve body to be pressed in its opening direction when the nozzle is connected to the connecting portion, and a valve body energizing member adapted to energize the valve body in its closing direction, wherein the buffer mechanism is adapted to elastically receive the nozzle by an energizing force of the valve body energizing member, wherein the connecting portion includes a connecting unit main body which is immovable relative to a main body of a driving tool, wherein an internal space is formed within the connecting unit main body, wherein the valve body and the valve body energizing member are disposed in the internal space, wherein the internal space is configured such that the nozzle of the fuel container enters the internal space in a condition that the fuel container is mounted in the fuel container storing portion of the driving tool, and wherein the internal space is connected to a side of a combustion chamber of the driving tool.

* * * * *